United States Patent [19]

Snediker et al.

[11] 4,006,824

[45] Feb. 8, 1977

[54] DISPLAY AND DISPENSING STAND

[75] Inventors: Robert R. Snediker, Winnetka, Ill.; Steve Chalmers, St. Louis, Mo.; Robert E. Drapeau, Berwyn, Ill.

[73] Assignee: Brown & Williamson Tobacco Corporation, Louisville, Ky.

[22] Filed: Nov. 11, 1975

[21] Appl. No.: 631,130

[52] U.S. Cl. ..... 211/49 D; 312/45

[51] Int. Cl.[2] ..... A47F 5/11

[58] Field of Search ..... 221/242; 211/49, 128, 211/49 D; 312/42, 45

[56] References Cited

UNITED STATES PATENTS 2,649,348 8/1953 Calhoun et al. ..... 312/45

*Primary Examiner*—Stanley H. Tollberg
*Attorney, Agent, or Firm*—William J. Mason

[57] ABSTRACT

A stand for displaying and dispensing articles having at least one inclined article holding tray. The tray has a plurality of parallel channels made up of upstanding parallel sidewalls terminating at a front end wall. Two of the sidewalls that are symmetrically placed with respect to the width of the trays have receiving fissures therein. They receive connecting blades from supporting members that maintain the trays in the desired inclined position. The supporting members are generally planar and have upper and lower connecting blades. In a display stand utilizing a plurality of inclined trays arranged in a vertical array, the supporting members are between the trays with the upper connecting blade within the lower mounting fissure of the tray above and the lower connecting blade within the upper mounting fissure in the tray below. The lowermost tray is supported on some elevating means to incline the trays and that elevating means may be a supporting member. When a supporting member is used as the elevating means, the upper and lower connecting blades are unused and a frontal connecting blade on the supporting member is within the lower fissure of the lowermost tray.

37 Claims, 12 Drawing Figures

DISPLAY AND DISPENSING STAND

BACKGROUND OF THE INVENTION

The present invention relates to that field of the art where articles are stored, displayed and dispensed from inclined article holding means.

More particularly, the present invention relates to a display and dispensing stand utilizing a plurality of inclined trays to contain the articles to be dispensed. Such devices are extremely important in the commercial setting since, exclusive of the packaging on the article, the display and dispensing means is the primary interface between the consumer and the article being sold. The final selection process by the consumer is made with the article in the setting created by the display and dispensing stand.

The commercial setting produces a number of demands on such devices that must be met if they are to be commercially successful. The first requirement for such a device is that it not discourage those who have already made a conscious decision to buy the article displayed. This is accomplished by making the article easy to identify and easy to remove from the dispensing means. The present invenion displays the articles themselves in the device in a manner facilitating location and identification. Furthermore, the invention has capabilities for mounting advertising directly on the device in a manner that does not obscure the display of the articles themselves. This advertising capability allows the use of various changeable advertising displays on the device that could be used to influence the decision-making of consumers that have not yet made a buying decision. Once the articles have been located, the open structure of the invention allows the articles to be easily and conveniently removed from the display.

While the manufacturer and the wholesale distributor of such articles have primary concern over the positive sales effect generated by a successful display stand, such a device is normally used in the premises of another who has additional concerns. The retailer who uses the device also wishes it to positively influence the buying decision of consumers, but in addition, the retailer is concerned with aesthetics and maintenance.

In the retail setting, the display cannot be so garish that it adversely affects the overall appearance the retailer tries to present to his customers. The display should present the articles positively yet not overpower adjacent displays to the overall detriment of the retail establishment. The display should also have the capability of utilizing changeable advertising allowing the retailer to vary the appearance of the display periodically and present local information such as prices, sales, etc.

A further concern of the retailer is the maintenance of such devices. Preferably, the device should be strong, light and easily assembled so it can be readily assembled and disassembled to facilitate storage and movement. In addition, the device should be easily modified to various sizes to permit its use in different settings where the space constraints or variations in quantity of articles stored or displayed can be accommodated.

Furthermore, the device should have sufficient capacity for the displayed articles that it need not be constantly monitored and filled. In addition, it should replinish the articles to the display position from storage positions as the articles are depleted.

Therefore, it is the primary object of this invention to provide a new and useful display and dispensing stand.

Another object of the invention is to provide an aesthetically pleasing and dispensing stand to influence the sale of articles therein by attracting consumers and facilitating the removal of articles from the stand.

A further object of the invention is to provide a display and dispensing stand that is easily maintained in that it is adaptable, easily assembled or disassembled and replinishes articles to the display position when the articles therein are depleted.

It is also an object of this invention to provide a display and dispensing stand that is modular in nature permitting the same structural components to be utilized to construct stands of various sizes and configurations.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

SUMMARY OF THE INVENTION

To achieve the foregoing objects and in accordance with the purpose of the invention as embodied and broadly described herein, the display and dispensing stand of this invention comprises a plurality of unitary trays having at least one channel for containing articles therein. The channel(s) are formed by a plurality of upstanding walls with the channels terminating at one end at a frontal abutment. The parallel sidewalls include two support sidewalls, symmetrically spaced with respect to the width of the tray. The support sidewalls include a plurality of receiving fissures therein. The receiving fissures comprise upper receiving fissures accessible from above the tray and lower receiving fissures accessible from below the tray. At least two planar supporting members spacially separate the trays, one above the other. Each of the supporting members have at least two connecting blades, an upper connecting blade engaging the lower receiving fissure of the tray above the supporting member and a lower connecting blade engaging the upper receiving fissure of the tray below the supporting member. The supporting member further includes means for detachably affixing the trays to the supporting member to prevent relative movemet therebetween. The display stand further includes means, placed beneath the bottom tray of the display stand, for inclining the trays.

It is preferred that the supporting members comprise planar members having front, rear, upper and lower portions. The upper portion of the planar member includes an upper connecting blade projecting above an upper supporting means on the supporting member, for providing a surface support for the tray located above the supporting member. The upper supporting means provide a surface on which the bottom of the tray above the supporting member is supported when the connecting upper blade is engaged in the bottom receiving fissure of the tray. The lower portion includes a lower connecting blade projecting below a lower supporting means, on the supporting member, for providing a supporting surface against the tray located below the supporting member. The lower supporting means supports the supporting member above the upper receiving fissure of the tray below the supporting member when the lower connecting blade is placed within the upper fissure.

It is also preferred that the supporting members have on their front portion a frontal blade capable of engaging the bottom fissure in the trays when the supporting member is positioned beneath the lowermost tray. The supporting member also includes a frontal supporting means adjacent to the frontal blade to support the tray when the frontal blade is engaged in the bottom receiving fissure.

It is further preferred that the inclining means comprise two of the supporting members with the frontal blades engaging the bottom fissures in the lowermost tray and the surface supporting the display stand contacting the rear edge of the two supporting members.

An additional preferred structure of the display and dispensing stand comprises a unitary tray having a plurality of channels for containing articles. The channels are formed by a plurality of upstanding parallel walls. The walls include two supporting sidewalls symmetrically spaced with respect to the width of the tray. The supporting sidewalls include a plurality of receiving fissures therein. The receiving fissures comprise upper receiving fissures accessible from above the tray and lower receiving fissures accessible from below the tray. A pair of planar members support the tray in an inclined position. Each of the support members have a lower edge for standing on a planar surface, and an upper edge. The upper edge has an upper connecting blade portion for insertion into the lower receiving fissure and a supporting means on the planar member adjacent the upper connecting blade portion for interacting with the bottom of the tray to maintain the tray in an inclined position.

BRIEF DESCRIPTION OF THE DRAWINGS

The invention consists in the novel parts, constructions, arrangements, combinations and improvements shown and described in the accompanying drawings which are incorporated in and constitute a part of the specification, illustrate one embodiment of the invention and together wih the description serve to explain the principles of the invention. Of the drawings.

DESCRIPTION OF THE PREFERRED EMBODIMENTS

Reference will not be made in detail to the present preferred embodiments of the invention, an example of which is illustrated in the accompanying drawings.

The figures depict a device 10 for displaying and dispensing articles. The articles contemplated for use with the invention are cigarette packages, however, the invention is not limited thereto and may display and dispense any type of articles fitting within the article-holding channels.

Figure 4:
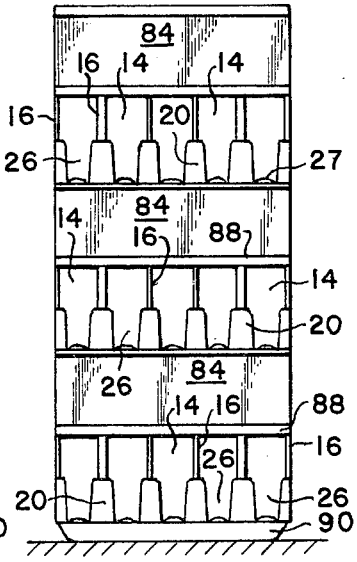
FIG. 4 is a frontal view of the embodiment depicted in FIGS. 1 through 3.

In accordance with the invention, a plurality of trays 12 are provided with the trays having at least one article-holding channel therein. The size of the channel(s) is determined by the size of the articles to be contained. The channels are formed by a plurality of upstanding sidewalls depicted in FIG. 4 as parallel sidewalls 16. The distance between sidewalls and the height of the sidewalls are disposed to provide a channel having interior dimensions to receive and contain a plurality of articles in a stacked array within the channels. Preferably, the sidewalls 16 include means for providing lateral access to articles within the channels 14, as depicted in FIG. 4. For purposes of this disclosure, lateral access is access to the articles within the channels from a horizontal direction perpendicular to the longitudinal axis of the channels 14.

Figure 3:
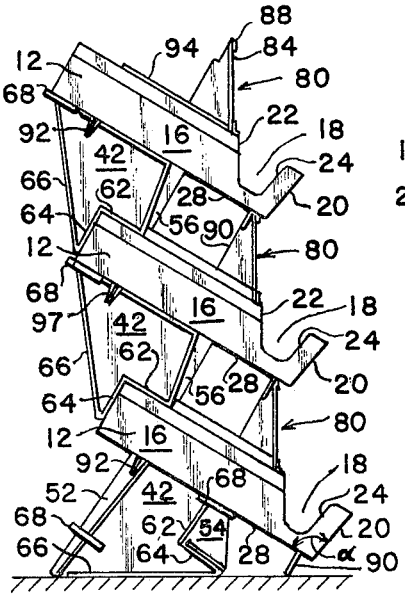
FIG. 3 is a side view of the embodiment depicted in FIGS. 1 and 2.

As here embodied and best depicted in FIG. 3, the lateral access means comprise a plurality of cut-out portions 18 defined by the sidewall 16, with the cut-out portions 18 preferably located adjacent the frontal end wall 20 comprising the abutment means of the channel 14. Providing lateral access to the articles adjacent the frontal end wall is preferred since this is the display location of the articles and the access means should preferably be at the same location.

Preferably, the cut-out portions 18 have the configuration most clearly depicted in FIG. 3 where the rear edge 22 of the cut-out portion 18 is substantially perpendicular to the surface on which the stand rests. In such a preferred configuration, the side view of the device 10 presents a generally planar appearance except for the articles in the display portion of the device and the frontal extremity of the channels 14. A subsequent porion of the disclosure will be directed to substantially planar members between the trays that are also preferably perpendicular to the surface on which the device rests. The preferred configuration of the rear edge 22 of the cut-out portions 18 interacts wih these planar members to present an aesthetically clean planar appearance to the display portion of the device. As depicted in FIG. 3, it is also preferred that the front edge 24 of the cut-out portion 18 be parallel to the frontal end wall 20 to form an essentially V-shaped sidewall cut-out portion 18.

The channels 14 terminate at one end by an abutment means, herein depicted as frontal end wall 20. As embodied in FIG. 4, the frontal end wall 20 is placed on the lowermost end of the trays 12 to limit the movement of articles within the channels 14. Preferably, the frontal end walls include means for providing frontal access to articles within the channels 14. As here embodied and most clearly depicted in FIG. 4, the means for providing frontal access to the articles is a vertical slot 26 defined by the frontal end wall 16. Preferably, the slot 26 is tapered and divergent from the bottom 28 of the channel 14. It is also preferred that the frontal end wall be angularly disposed from the bottom 28 of the channels 14, an angle greater than 90°. As depicted in FIG. 3 as the angle $\zeta$ the frontal end wall 20 is inclined in a manner that facilitates the dispensing of articles within the channels 14. With the endwalls so inclined, the articles therein are not stacked exactly on top of one another and, therefore, individual articles are easily grasped from the front of the device.

Figure 5:
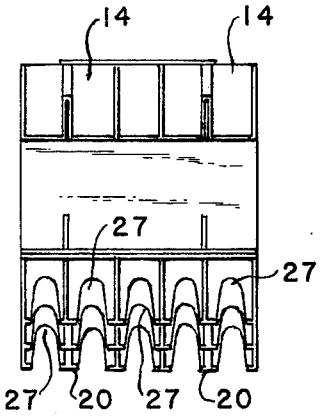
FIG. 5 is a top view of the embodiment depicted in FIGS. 1 through 4.

It is also preferred that the bottom 28 of the tray 12 include a cutout portion to further improve frontal access to the articles within the trays. As most clearly depicted in FIG. 5, the bottom 28 includes semi-circular cut-out portions 27. The cut-out portions 27 especially improve access to the lowermost article within the channel 14.

The preferred configuration of the device as disclosed herein provides an aesthetically pleasing display portion of the device while also providing both frontal and lateral access to the articles within the channels 14.

The parallel sidewalls 16 include two support sidewalls 30 symmetrically placed with respect to the width of the tray 12. The support sidewalls contain a plurality of receiving fissures therein. The receiving fissures include upper receiving fissures that are accessible from above the tray and lower receiving fissures accessible from below the tray.

Figure 6:
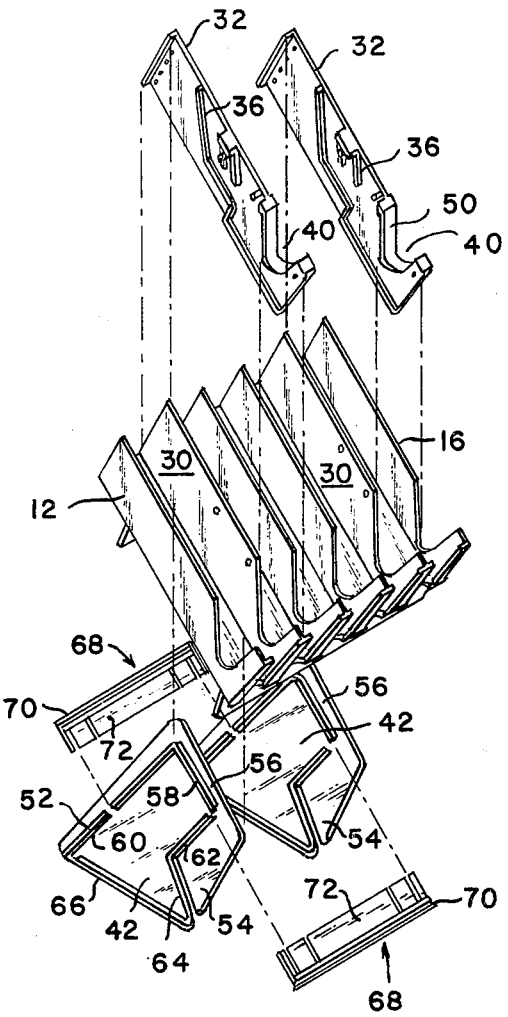
FIG. 6 is an exploded view of one embodiment of the present invention.
Figure 7:
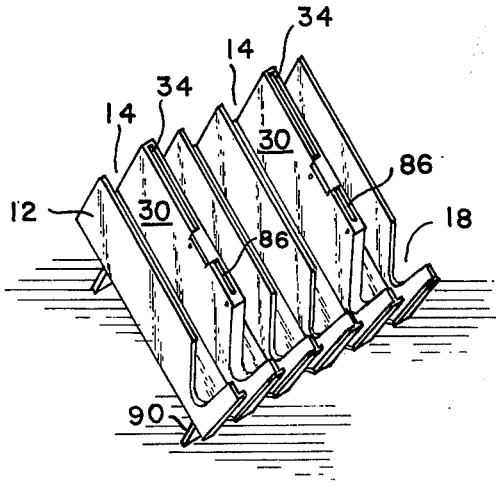
FIG. 7 is a perspective view of one tray embodiment of the present invention.
Figure 9:
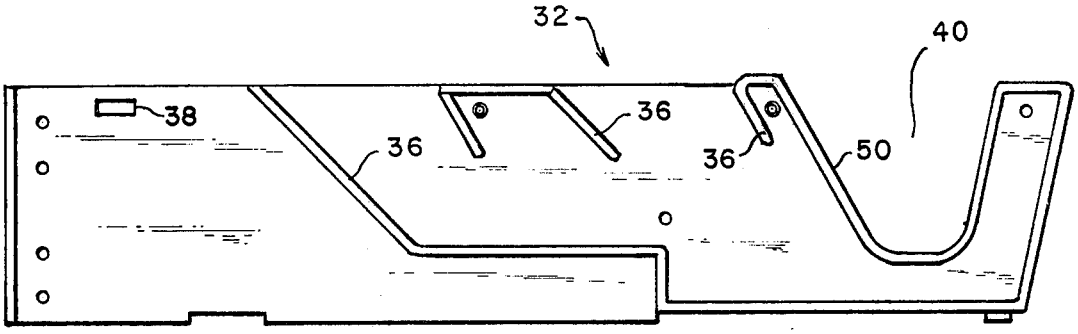
FIG. 9 is a side view of one embodiment of a doubling member.
Figure 10:
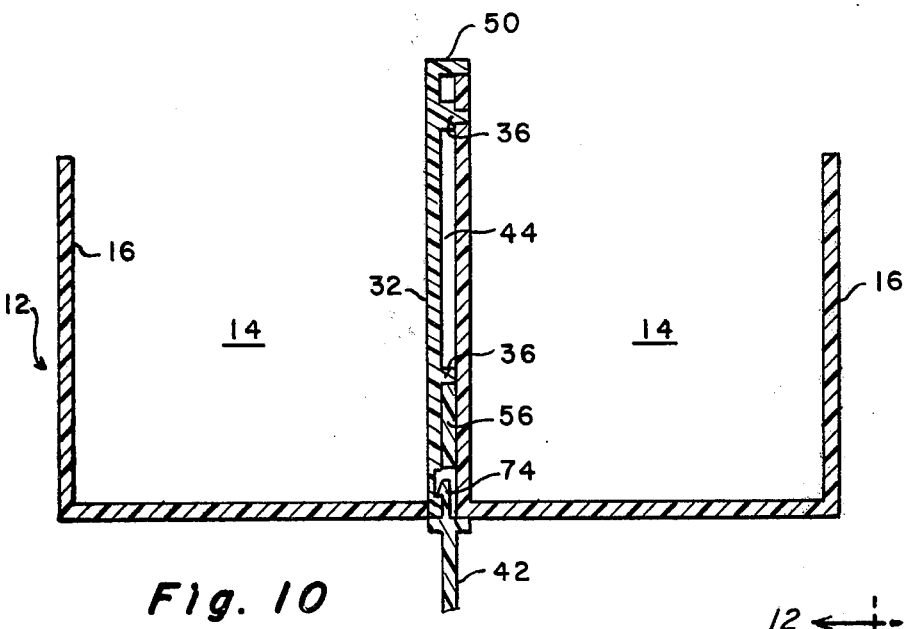
FIG. 10 is a cross-sectional view of a doubling member affixed to a channel sidewall to form a receiving fissure.

As here embodied and most clearly depicted in FIGS. 6, 7, and 10, the support sidewalls 30 are formed by attaching two planar doubling members 32 to two channel sidewalls. The two channel sidewalls are symmetrically placed with respect to the width of the tray 12. The doubling member 32 includes separating means to keep the doubling member 32 spacially separated from the sidewall to which it is attached there by forming a receiving fissure 44 between the sidewall and the doubling member as depicted in FIG. 10. As depicted in FIG. 7, the upper receiving fissure 34 is accessible from above the tray. The lower receiving fissure (not shown) is immediately below the upper receiving fissure 34 and incudes an elongated slot (not shown) in the bottom 28 of the channel 14 to provide access to the space between the sidewall and the doubling member 32 forming the receiving fissure 44. The separating means for the doubling member 32 is depicted in FIGS. 6, 9 and 10 as ridges 36. The ridges 36 also serve as means for restraining the movement of blades within the fissures in a direction parallel to the sidewalls. While the restraining means are disclosed as ridges 36, it should be obvious that the function of the ridges 36 could also be carried out by a plurality of pins appropriately placed to restrain the blades placed within the fissures.

While the embodiments depicted in the figures form the receiving fissures by the addition of separate doubling members, it should be obvious that the fissures may be formed as an integral portion of the trays 12. Preferably, the receiving fissures include means for affixing blade members placed within the fissures. As here embodied and depicted in FIG. 9, the blade affixing means are simply slots 38 disposed to catch and receive protruding portions of the blades inserted into the receiving fissure adjacent the slots 38. The doubling member 32 depicted in FIG. 9 conforms to the outline of the sidewalls 16 and includes cut-out portions 40 in the doubler that coincide with the cut-out portions 18 in the sidewalls 16. In that manner, the doubling members do not interfere with the lateral access to the articles within the channels while presenting an aesthetically clean uncluttered appearance to the tray structure as depicted in FIG. 7.

Figure 12:
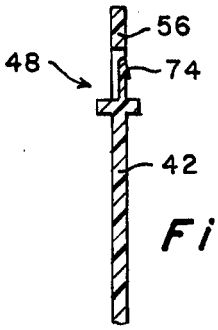
FIG. 12 is a cross-sectional view of the supporting member of FIG. 11 along lines 12—12.

A preferred structure for the doubling member is depicted in cross-section in FIG. 10 where the planar doubling member 32 forms the receiving fissures 44 between the sidewall 16 and the doubling member. The receiving fissure 44 is merely the space between the two members and depending on the access provided to the receiving fissure 44, it may form the upper receiving fissure 34 or the lower receiving fissure (not shown). The separating means depicted are ridges 36 with the doubling member 32 affixed to a blade member 56 by the catch structure 48 most clearly depicted in FIGS. 10 and 12. The flange 50 covers a portion of the receiving fissure 44 to provide the aesthetically clean appearance of the tray 12.

In accordance with the invention at least two planar supporting members are provided to spacially separate the trays one above the other in an inclined position with the bottoms of the trays substantially parallel. As here embodied and most clearly depicted in FIG. 11, the supporting member 42 has at least two connecting blades, an upper connecting blade 52 and a lower connecting blade 54. The upper connecting blade 52 is disposed to fit within the lower receiving fissure (not shown). The lower connecting blade 54 is disposed to fit within the upper receiving fissure (34 in FIG. 7).

Preferably, the supporting member has a frontal connecting blade 56 that is disposed to fit within the lower receiving fissure of the trays 12 when the supporting member is used to support the lowermost tray. When the supporting member is used between two vertically spaced trays, the frontal connecting blade 56 is unused as depicted in FIG. 3. As depicted in FIG. 10, the frontal blade 56, the upper and lower connecting blades 52 and 54 respectively, all have ridges associated therewith. The frontal, upper and lower connecting blade ridges 58, 60 and 62 respectively, are means for locating the blades within the respective receiving fissures and thereby supporting the supporting member 42. The supporting means need not be of the exact embodiment depicted and a plurality of protrusions, pins or abbreviated ridges would also serve as such supporting means. The frontal connector blade ridge 58 serves to limit the insertion of the frontal connector blade 56 within the lower receiving fissure when the blade is inserted therein. Similarly, the upper connecting blade ridge 60 limits the insertion of the upper connecting blade 52 when it is placed within the lower receiving fissure. The supporting member 42 may also include an end supporting means adjacent the lower connecting blade. As herein embodied and depicted in FIGS. 3, 6 and 10, the end supporting means comprises an end ridge 64 at substantially right angles to the lower connecting blade ridge 62. The function of the end supporting means is to prevent the supporting member and trays affixed thereto from sliding when the trays 12 are inclined.

Figure 11:
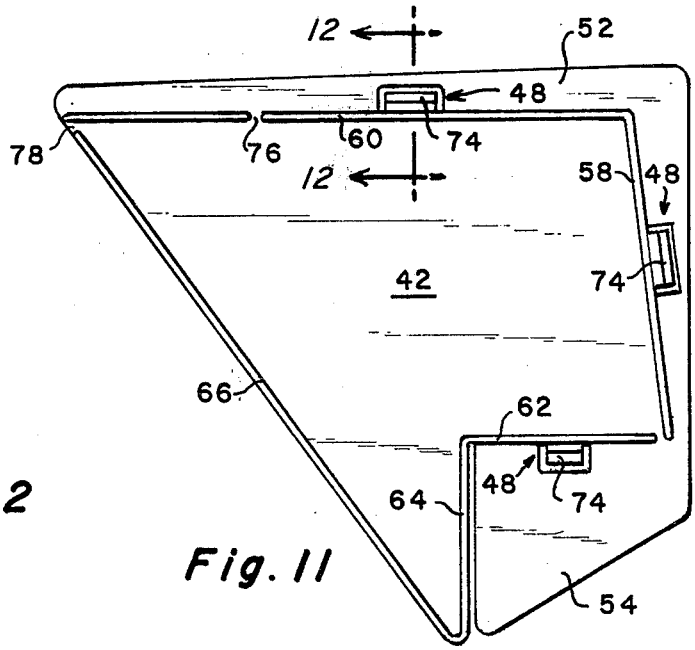
FIG. 11 is a side view of a preferred embodiment of a supporting member.

It is also preferred that the rear portion of the supporting member have a flat rear edge 66 with the rear edge angularly disposed from the front locating ridge 58, an angle equal to that at which the trays 12 are inclined from horizontal. The preferred indentity of angles is depicted in FIG. 11 as the angles $\beta$. With such an identity of angles, this embodiment provides an exceptional savings in materials and a reduction in complexity. This embodiment of the invention (as depicted most clearly in FIG. 3) can use the supporting members 42 either to separate and support two trays in a vertical array by engaging the upper and lower connecting blades (52 and 54 respectively) with the lower and upper receiving fissures respectively or the supporting member 42 can be placed with the rear edge 56 on the surface supporting the device with the lowermost tray 12 receiving the frontal connecting blade 56 in the lower receiving fissure (not shown). With the supporting member 42 in the later position, it comprises the means to incline the trays 12. The adaptability of the supporting member 42 of such a preferred configuration eliminates the need or a separate structural element for inclining the lowermost tray. Preferably, any means used to incline the lowermost tray either with a unique tray inclining element or a supporting member 42 in the aforementioned position will incline the lowermost tray an angle from the horizontal less than 45°.

Preferably, the connecting blades will include means for locking the blades within the receiving fissures. As here embodied and depicted in FIGS. 11 and 12, the supporting member 42 includes a locking catch 74 comprising a deflecting catch member 76 that is disposed to engage an edge within the receiving fissures thereby locking the supporting member within the fissures. The receiving fissures may also include access holes (not shown) allowing the deflecting catch member 76 to be disengaged to allow subsequent disassembly of the device.

Figure 1:
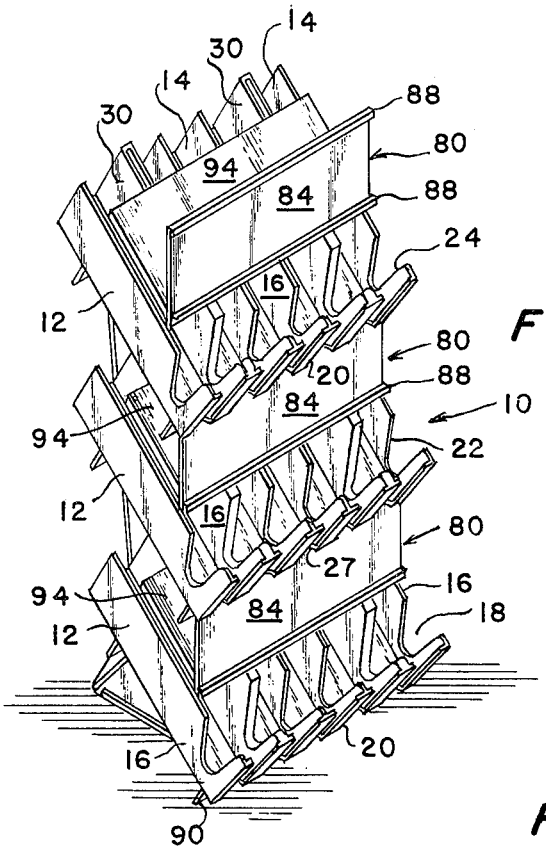
FIG. 1. is a perspective view of one embodiment of the invention utilizing a stacked arrangement of three unitary trays.

The receiving fissures within the trays provide a measure of stability to the device since the internal sides of the receiving fissures contact and laterally support the connecting blades. It is preferable, however, to provide additional means of stabilizing the compound parts of the device. Preferably, the supporting members and the inclining means are stabilized by means for connecting adjacent pairs of the supporting members. in FIGS. 6 and 8, a preferred connecting means is depicted as an elongated planar connecting member 68. The preferred connecting member has an elongated reinforced edge portion 70 and a planar portion 72 slotted to engage pairs of supporting members 42. In the embodiment depicted in FIGS. 1 and 3, where supporting member 42 are utilized as the inclining means, they are stabilized by affixing a connecting member 68 to the upper portion of the supporting member 42 at the upper connecting blade 52. The upper supporting means, the upper connecting ridge 60 has a notch 76, depicted in FIG. 11, to accommodate the passage of the planar portion 72 of the connecting member 68 through the ridge 60. It is further preferred that the supporting member 42 utilized as inclining means be further stabilized by placing a connecting member 68 between the lower connecting blades 54. As depicted in FIG. 3, the connecting member 68 on the lower connecting blade 54 is preferably placed immediately beneath the bottom 28 of the trays 12. In such a preferred portion, the connecting member not only stabilizes the supporting members 42 used as elevating means, but it also provides a further support for the trays 12.

When the supporting members 12 are used between pairs of trays with the upper and lower connecting blades within receiving fissures, it is preferred that the support members be further stabilized by connecting the pairs of supporting members. The supporting members are connected in the manner depicted in FIG. 3 by passing a connecting member 68 through the rear portion of the supporting member. Preferably, the connecting member is placed immediately adjacent the bottom 28 of the tray 12 to provide additional support to the tray. As depicted in FIG. 11, the supporting member 42 has a notch 78 in the flat rear edge 66 to allow passage of the planar portion 72 of the connecting member to pass through the rear edge. The notches 76 and 78 allow the planar portion of the connecting member to contact the sides of the supporting member further stabilizing the structure.

Figure 8:
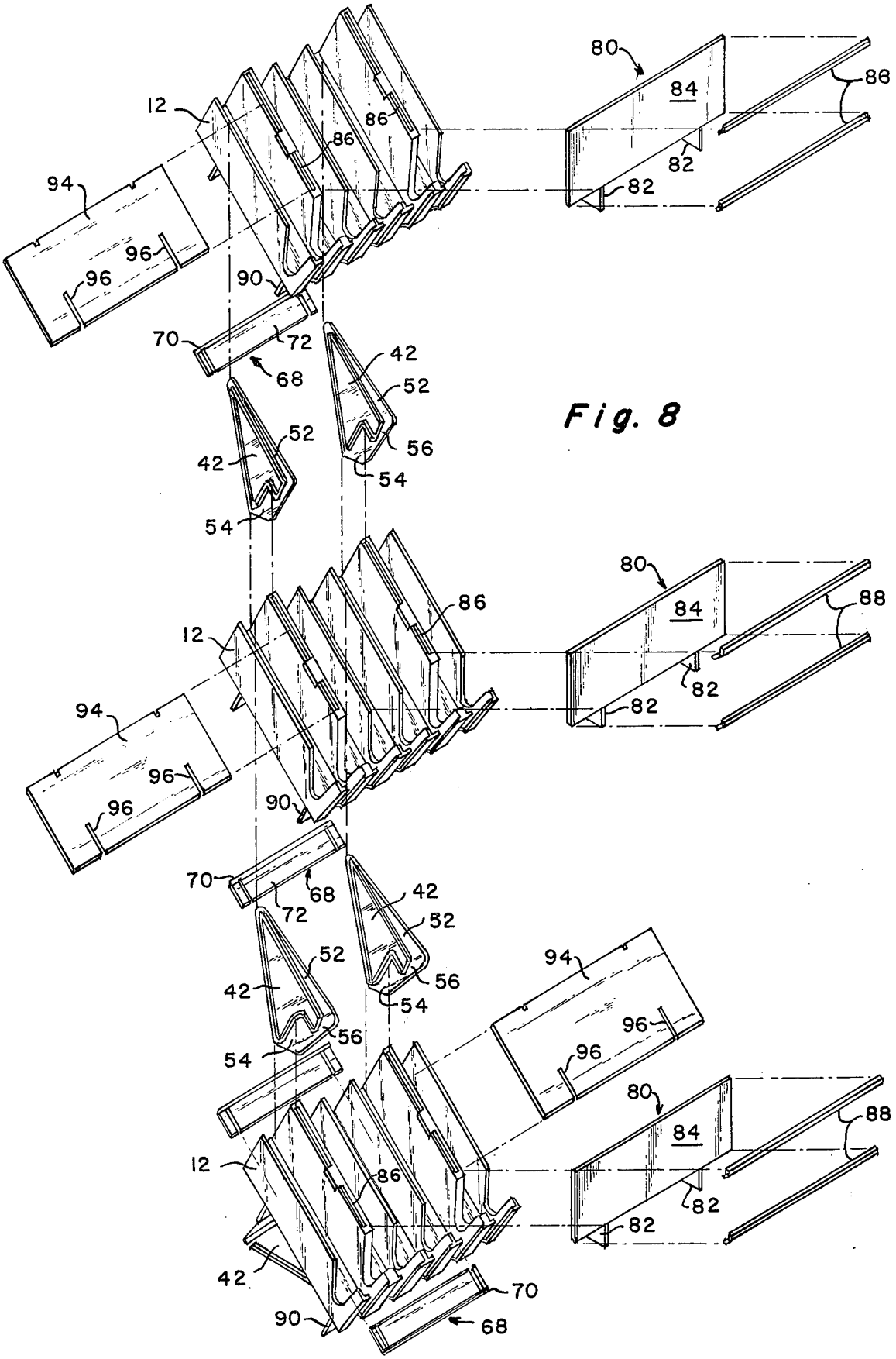
FIG. 8 is an exploded view of the present invention utilizing three unitary trays and the preferred supporting member structure.

Preferably, the device 10 includes planar members between the trays capable of displaying printed material. As here embodied and depicted in FIGS. 1, 3 and 8, the device 10 includes header member 80. The header member 80 is comprised of a header blade 82 and a planar header surface 84. The header blade 82 is disposed to fit within a portion of the upper receiving fissure 34 as depicted in FIGS. 7, 8 and 9 as forward upper receiving fissure 86. The planar header surface 84 is disposed to cover the space between the trays 12 adjacent the frontal end wall 20. Preferably, the planar header surface 84 is substantially perpendicular to the surface on which the stand rests. The desired function of the planar surface 84 is to provide space for advertising or the like between the trays. The advertising may be printed directly on the planar header surface 84 or the surface can provide means for affixing printed material thereto. As here embodied and most clearly depicted in FIG. 8, the planar header surface 84 includes on its upper and lower edges transverse channels 88 disposed to receive and retain printed material placed between the channels.

Figure 2:
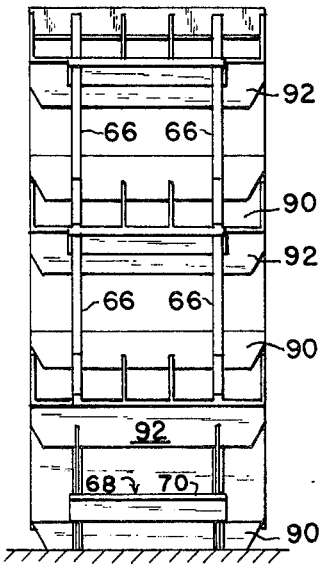
FIG. 2. is the rear view of the embodiment of the invention as depicted in FIG. 1.

Preferably, the trays 12 include a frontal tansverse rib 90 projecting from the bottom 28 adjacent the fontal end wall 20. As here embodied and most clearly depicted in FIG. 3, the frontal transverse rib 90 may also interact with the header members 80. In such an embodiment, the header members not only cover the space between trays, but provide support for the front of the trays. It is also preferred that the trays have a rear transverse rib 92, as depicted most clearly in FIGS. 2 and 3. The rear transverse rib 92 engages the supporting members 42 to further stabilize the device. In such an embodiment, it is preferred that the upper connecting ridge notch 76 be positioned to receive the rear transverse rib 92 as well as the connection as previously disclosed. Since the connecting member 68 is not constrained to a set position when it is placed in the upper connecting blade 52 (when the supporting member 42 is utilized as the inclining means), placement of the upper connecting ridge notch 76 to accommodate the rear transverse rib 92 will automatically accommodate the connecting member 68.

It is also preferred that the device 10 include a detachable tray cover over the channels 14. As here embodied and depicted in FIG. 8, the rectangular planar tray covers 94 are placed over the channels 14 immediately behind and adjacent the header members 80. Preferably, the tray covers 94 would have slots 96 therein to engage the header blades 82 and thereby detachably affix the tray covers 94 to the device 10.

The invention as disclosed herein provides an aesthetically attractive display and dispensing stand that effectively displays and dispenses articles therefrom while being strong, light, inexpensive and adaptable. While the invention has been disclosed by preferred embodiments, one skilled in the art may modify or add to the disclosed embodiment without departing from the scope of the invention as defined by the appended claims. What is claimed is:

1. A display and dispensing stand comprising:

a. a plurality of unitary trays having at least one channel for containing articles, said channel being formed by a plurality of upstanding sidewalls, said trays including at one extremity of said channels a frontal abutment means, said side walls including two support side walls symmetrically placed with respect to the width of said tray, said support side walls including a plurality of receiving fissures therein, said receiving fissures comprising upper receiving fissures accessible from above said tray and lower receiving fissures accessible from below said tray;

b. at least two planar supporting members spacially separating said trays one above the other, each of said supporting members having at least two connecting blades, an upper connecting blade engaging the lower fissure of the tray above said supporting member and a lower connecting blade engaging the upper fissure of the tray below said supporting member, said supporting member further including means for detachably affixing said trays to said supporting member to prevent relative movement therebetween; and c. means for inclining said trays, said inclining means being placed beneath the bottom tray of said display stand.

2. The display and dispensing stand of claim 1 wherein said supporting members comprise planar members having front, rear, upper and lower portions, said upper portion including said upper connecting blade, means on the upper connecting blade of said supporting member for locating said blade within said fissure, said upper locating means supporting the bottom of said tray when said upper connecting blade is engaged in said bottom fissure, said lower portion including said lower connecting blade and lower supporting means, said lower supporting means supporting said supporting member above said upper fissure when said lower connecting blade is placed within said upper fissure.

3. The display and dispensing stand of claim 2 wherein each of said supporting members have on their front portion a frontal blade capable of engaging the bottom fissure in said trays, said supporting member also including a frontal supporting means adjacent said frontal blade to locate said frontal blade within said bottom fissure thereby supporting said tray.

4. The display and dispensing stand of claim 3 wherein said lower portion of each of said supporting members includes an end supporting means adjacent said lower connecting blade, said end supporting means being at substantially right angles to said lower supporting means and disposed to prevent said supporting member and trays affixed thereto from sliding when said trays are inclined.

5. The display and dispensing stand of claim 4 wherein said rear portion of each of said supporting members includes a flat rear edge, said rear edge being angularly disposed from said frontal supporting means an angle equal to the angle at which said trays are inclined from horizontal.

6. The display and dispensing stand of claim 5 wherein said inclining means cimprise two of said supporting members with said frontal blades engaging said bottom fissure on the lowermost tray with the surface supporting said display stand contacting said rear edge of said two supporting members.

7. The display and dispensing stand of claim 1 wherein said channels have parallel sidewalls, said abutment means comprise a frontal end wall on the lowermost end of said trays, said frontal end wall having means for providing frontal access to articles within said channels.

8. The display and dispensing stand of claim 7 wherein means for providing frontal access comprises a tapered slot in said frontal end wall, said tapered slot being divergent from the bottom of said channel.

9. The display and dispensing stand of claim 7 wherein said walls define cut-out portions adjacent said frontal end wall, said cut-out portions providing lateral access to articles within said channels.

10. The display and dispensing stand of claim 9 wherein said cut-out portions have front and rear edges and said rear edge is substantially perpendicular to the surface on which said stand rests.

11. The display and dispensing stand of claim 10 wherein said cut-out portions are substantially V-shaped with the front edge of said first cut-out portion being substantially parallel to said end wall.

12. The display and dispensing stand of claim 11 wherein said end wall is angularly displaced from the bottom of said trays greater than 90°.

13. The display and dispensing stand of claim 1 wherein said receiving fissures are formed by attaching to said side walls a planar doubling member, said doubling member including separating means keeping said doubling member spacially separated from said side walls thereby forming said fissure between said supporting side wall and said doubling member.

14. The display and dispensing stand of claim 13 wherein said doubling member includes means for affixing blade members placed within said fissures.

15. The display and dispensing stand of claim 13 wherein said doubling member includes means within said fissures for restraining movement of blades within said fissures in a direction parallel to the longitudinal axis of said side walls.

16. The display and dispensing stand of claim 13 wherein said doubling members form forward upper fissures and said stand includes at least one header member having header blades engaged in said forward upper fissures and a planar header surface substantially covering the space between said trays adjacent the frontal end wall of said trays.

17. The display and dispensing stand of claim 16 wherein said planar header surface is approximately perpendicular to the surface on which said stand rests.

18. The display and dispensing stand of claim 17 wherein said planar header includes upper and lower transverse channels on the upper and lower edges of said header surface disposed to receive and retain planar pringed material placed between said channels.

19. The display and dispensing stand of claim 2 wherein said trays include a frontal planar transverse rib projecting from the bottom of said trays adjacent said abutment means and a rear planar transverse rib projecting from said bottom adjacent the end of said trays opposite said abutment means, said supporting members having openings in said upper supporting means to allow passage of said rear transverse rib therethrough.

20. The display and dispensing stand of claim 6 wherein said supporting members and said inclining means are stabilized by means for connecting adjacent pairs of said supporting members.

21. The display and dispensing stand of claim 20 wherein said connecting means is an elongated planar connecting member having an elongated reinforced edge portion and a planar portion slotted to engage adjacent pairs of said supporting members.

22. The display and dispensing stand of claim 21 wherein said inclining means consisting of two supporting members are connected by means of said connecting member affixed to said upper portion of said supporting members, said upper means having notches therein to accommodate the passage of said planar portion of said connecting member.

23. The display and dispensing stand of claim 22 wherein said inclining means includes a connecting member between said lower connecting blades.

24. The display and dispensing stand of claim 14 wherein said supporting members between said trays are connected by affixing said connecting member to said rear portion of said supporting members, said flat rear edge having openings therein to accommodate passage of said planar portion of said connecting member therethrough.

25. The display and dispensing stand of claim 1 wherein said inclining means place the bottom of said trays at an angle less than 45° from horizontal with the bottom of each said trays being substantially parallel to one another.

26. The display and dispensing stand of claim 1 wherein each of said trays include a detachable rectangular planar tray cover placed over said channels.

27. The display and dispensing stand of claim 16 wherein each of said trays include a detachable rectangular planar tray cover placed over said channels covering said channels between said supporting means and said planar header surface, said cover having slots therein to allow passage of said header blade through the front portion of said cover.

28. A display and dispensing stand comprising:

a. a unitary tray having a plurality of channels for containing articles, said channels being formed by a plurality of upstanding parallel walls, said walls including two support walls symmetrically placed with respect to the width of said tray, said support walls including a plurality of fissures therein, said fissures comprising upper fissures accessible from above said tray and lower fissures accessible from below said tray; and b. a pair of planar members for supporting said tray in an inclined position, each of said members having a lower edge for standing on a planar surface, a forward edge, a rearward edge and an upper edge having an upper blade portion for insertion into said lower fissure and a ridge means on said planar member adjacent said upper blade portion for interacting with the bottom of said tray for maintaining said tray in an inclined position.

29. The display and dispensing stand of claim 28 wherein said channels include a frontal end wall having means for providing frontal access to articles within said channels.

30. The display and dispensing stand of claim 29 wherein said walls define cut-out portions adjacent said frontal end wall said cut-out portions providing lateral access to articles within said channels.

31. The display and dispensing stand of claim 28 wherein said upper blade includes means for locking said blade within said lower fissure.

32. The display and dispensing stand of claim 28 wherein said planar members are stabilized by means for connecting said pair of planar members.

33. A supporting member for spacially separating a plurality of trays containing top and bottom receiving fissures, said supporting member comprising a substantially planar member having front, rear, upper and lower portions, said upper portion including upper connecting blade, means on said upper connecting blade of said supporting member for locating said blade within said bottom fissure, upper supporting means on said member for supporting the bottom of said tray when said upper connecting blade is engaged in said bottom fissure, said lower portion including a lower connecting blade and lower supporting means, said supporting means supporting said supporting member above said upper fissure when said lower connecting blade is placed within said upper fissure.

34. The supporting member of claim 33 wherein each of said supporting members have on their front portion a frontal blade capable of engaging the bottom fissure in said trays, said supporting member also including a frontal supporting means adjacent said frontal blade to locate said frontal blade within said bottom fissure thereby supporting said tray.

35. The supporting member of claim 34 wherein said lower portion of each of said supporting members includes an end supporting means adjacent said lower connecting blade, said end supporting means being at substantially right angles to said lower supporting means and disposed to prevent said supporting member and trays affixed thereto from sliding when said trays are inclined.

36. The supporting member of claim 35 wherein said rear portion of each of said supporting members includes a flat rear edge, said rear edge being angularly disposed from said frontal supporting means an angle equal to the angle at which said trays are inclined from horizontal.

37. The supporting member of claim 34 wherein said blades include means for locking said blades within said receiving fissures.

* * * * *

UNITED STATES PATENT OFFICE

CERTIFICATE OF CORRECTION

Patent No. 4,006,824 Dated February 8, 1977

Inventor(s) Snediker et al. Page 1 of 2

It is certified that error appears in the above-identified patent and that said Letters Patent are hereby corrected as shown below:

Column 2, line 1, change "replinish" to --replenish--.

Column 2, line 12, change "replinishes" to --replenishes--.

Column 2, line 52, change "movemet" to --movement--.

Column 3, line 46, change "wih" to --with--.

Column 5, line 10, change "$\zeta$" to --$\alpha$--.

Column 7, line 1, change "indentity" to --identity--.

Column 7, line 41, change "compound" to --component--.

Column 8, line 40, change "tansverse" to --transverse--

Column 8, line 42, change "fontal" to --frontal--.

Column 10, line 5, change "cimprise" to --comprise--.

UNITED STATES PATENT OFFICE

CERTIFICATE OF CORRECTION

Patent No. 4,006,824 Dated February 8, 1977

Inventor(s) Snediker et al. Page 2 of 2

It is certified that error appears in the above-identified patent and that said Letters Patent are hereby corrected as shown below:

Column 10, line 64, change "pringed" to --printed--.

Column 12, lines 32 and 33, change "said supporting means" to --said lower supporting means--.

Signed and Sealed this

Tenth Day of May 1977

[SEAL]

*Attest:*

RUTH C. MASON
*Attesting Officer*

C. MARSHALL DANN
*Commissioner of Patents and Trademarks*